US008566986B1

(12) United States Patent
Chu

(10) Patent No.: US 8,566,986 B1
(45) Date of Patent: Oct. 29, 2013

(54) MULTI-FUNCTIONAL PILLOW DEVICE

(71) Applicant: Hua Ling Chu, Taoyuan County (TW)

(72) Inventor: Hua Ling Chu, Taoyuan County (TW)

( * ) Notice: Subject to any disclaimer, the term of this patent is extended or adjusted under 35 U.S.C. 154(b) by 0 days.

(21) Appl. No.: 13/718,665

(22) Filed: Dec. 18, 2012

(51) Int. Cl.
*A47G 9/00* (2006.01)

(52) U.S. Cl.
USPC ..... 5/636; 5/639; 5/640; 5/904

(58) Field of Classification Search
USPC ..... 5/636, 630, 639–640, 904, 915
See application file for complete search history.

(56) References Cited

U.S. PATENT DOCUMENTS 1,742,186 A * 1/1930 Claus ..... 5/653
4,042,791 A * 8/1977 Wiseman ..... 381/109
4,638,884 A * 1/1987 Lee ..... 181/141
4,991,222 A * 2/1991 Nixdorf ..... 381/388
5,997,091 A * 12/1999 Rech et al. ..... 297/391
6,098,220 A * 8/2000 Momma ..... 5/636
6,640,367 B2 * 11/2003 Hsia ..... 5/640
7,370,446 B2 * 5/2008 Gross et al. ..... 38/107
D583,180 S * 12/2008 Haile ..... D6/601
7,685,661 B2 * 3/2010 Popilek et al. ..... 5/639
7,926,133 B2 * 4/2011 Xiao et al. ..... 5/639

* cited by examiner

*Primary Examiner* — Fredrick Conley

(57) ABSTRACT

A multi-functional pillow device is disclosed. The multi-functional pillow device comprises a main body, two side bodies and a control unit. The main body has a through hole for face down sleep, a matching element for fitting with the through hole, and a circuit board inside the main body for connecting to a vibration unit and a rotation unit. Each of the side bodies is connected to the rotation unit and has a speaker connected to the circuit board, wherein the side bodies are adjusted to a vertical position or a horizontal position by the rotation unit. The control unit is disposed at the external of the main body and is connected to the circuit board for setting and controlling the vibration unit and the rotation unit, and for inputing audio data into the circuit board for playing from the speakers.

5 Claims, 5 Drawing Sheets

MULTI-FUNCTIONAL PILLOW DEVICE

BACKGROUND OF THE INVENTION

1. Field of the Invention

The present invention relates to a multi-functional pillow device, particularly to a pillow device which accommodates face down sleep, allows input of audio music for playing from its speakers, and is equipped with a vibration unit for massage.

2. Description of Related Art

Normally a prior art pillow is a plane device suitable for sleeping on one's back (i.e. face up sleep) or sleeping on one's side. However, the prior art pillow is not comfortable for sleeping on one's stomach (i.e. face down sleep). Besides, the pillow may only be used for taking a nap and sleeping without any additional function; therefore the prior art pillow is low in value. Moreover, if one wants to listen to music during sleep, one can only place a media player or an MP3 player beside the pillow, which could be troublesome and may disturb someone else.

Therefore, a pillow device with multiple functions which is not only comfortable for any sleeping positions but also plays music and songs as well as provides massage is substantially required.

SUMMARY OF THE INVENTION

The primary object of the present disclosure is to offer a pillow device with multiple functions which is comfortable for any sleeping positions, allows a user to input music and listen from its speakers, and provides massage.

To achieve the above purposes, a multi-functional pillow device is disclosed. The multi-functional pillow device comprises a main body, two side bodies and a control unit. The main body has a through hole for face down sleep, a matching element for fitting with the through hole, and a circuit board inside the main body for connecting to a vibration unit and a rotation unit. Each of the side bodies is connected to the rotation unit and has a speaker connected to the circuit board. The side bodies can be adjusted to a vertical position or a horizontal position by the rotation unit. The control unit is disposed at the external of the main body and is connected to the circuit board for setting and controlling the vibration unit and the rotation unit, for inputing audio data from USB, MP3 storage, or computer, and for saving the audio data in the circuit board for playing from the speakers. The matching element can be fitted in the through hole of the main body with exact matching, and the vibration unit can be regulated to vibrate by the control unit.

According to one embodiment of the multi-functional pillow device, the through hole is circle shaped.

According to one embodiment of the multi-functional pillow device, the vibration unit is a motor which rotates an eccentric cam to generate vibration.

According to one embodiment of the multi-functional pillow device, the rotation unit has a motor disposed inside the main body and a rotative arm connected to the pivot of the motor and fixed to the side body. The side bodies are adjusted to a vertical position or a horizontal position when the motor drives the rotative arm to rotate.

According to one embodiment of the multi-functional pillow device, the control unit has pythoncidere disposed inside, which is released through a release opening.

To further understand the techniques, means and effects of the instant disclosure applied for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

Figure 1:
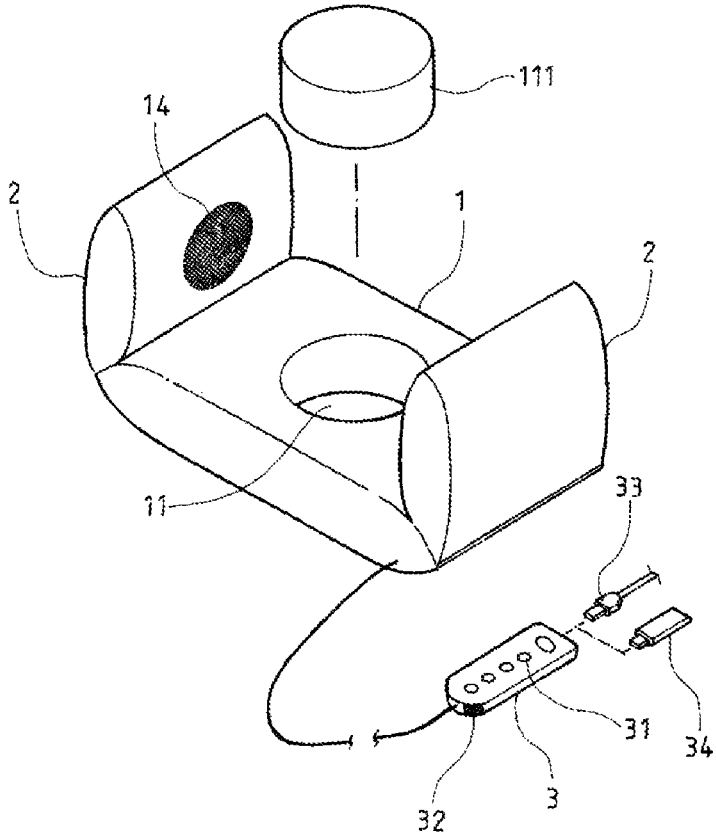
FIG. 1 is a schematic diagram of the present invention.
Figure 2:
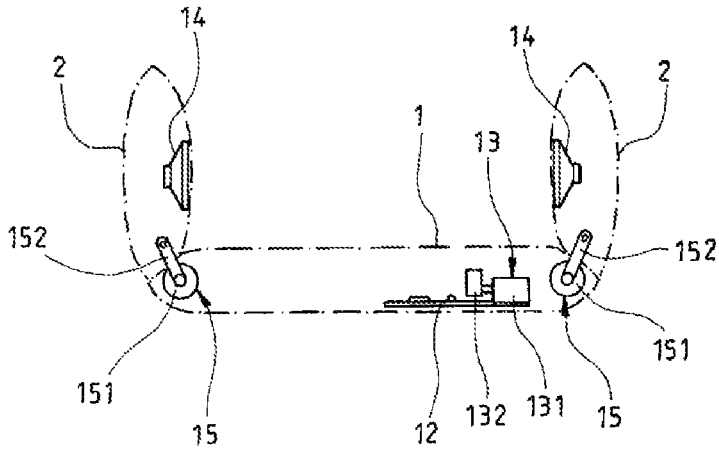
FIG. 2 is a schematic view showing the structures inside the pillow device of the present invention.

Please refer to FIG. 1 and FIG. 2. FIG. 1 is a schematic diagram of the present invention, and FIG. 2 is a schematic view showing the structures inside the pillow device of the present invention. As shown in the figures, a multi-functional pillow device according to the present invention comprises a main body 1 and two side bodies 2 connected to two laterals of the main body 1. The main body 1 has a through hole 11 disposed at the center of the main body 1 and a matching element 111 correspondingly fitted with the through hole 11. In the present embodiment, the through hole 11 is circle shaped, so the matching element 111 is a cylinder. The main body 1 has a circuit board 12 disposed inside. The circuit board 12 is connected to a vibration unit 13 and two speakers 14; the two speakers 14 are respectively disposed at the two side bodies 2. The vibration unit 13 is a motor 131 whose pivot is connected to an eccentric cam 132, so that the motor 131 may drive and rotate the eccentric cam 132 to generate vibration. The multi-functional pillow device further has rotation units 15 disposed between the main body 1 and the side bodies 2. Each of the two rotation units 15 has a motor 151 disposed at the main body 1, and the pivot of the motor 151 is connected to a rotative arm 152 which is disposed and fixed inside its corresponding side body 2. In this manner, the side bodies 2 may be adjusted to a vertical position or a horizontal position when the motors 151 drive the rotative arms 152 to rotate.

The circuit board 12 is connected to an external control unit 3, and the control unit 3 has a button 31 wired connected to the circuit board 12. The vibration unit 13 and the rotation unit 15 are set and controlled by the circuit board 12. The control unit 3 has pythoncidere disposed inside, which is released through a release opening 32.

The multi-functional pillow device may accommodate sleeping on one's stomach (i.e. face down sleep). Besides, some audio or music data may be input or installed from USB 33, MP3 storage 34 or computer and then saved in the circuit board 12, so that after the rotation unit 15 has driven and rotated the side bodies 2 into a vertical position the audio data (i.e. music) may be played from the speakers 14. Furthermore, the matching element 111 can be disposed in the through hole 11 and then the vibration unit 13 can be regulated to vibrate by the control unit 3.

Figure 3:
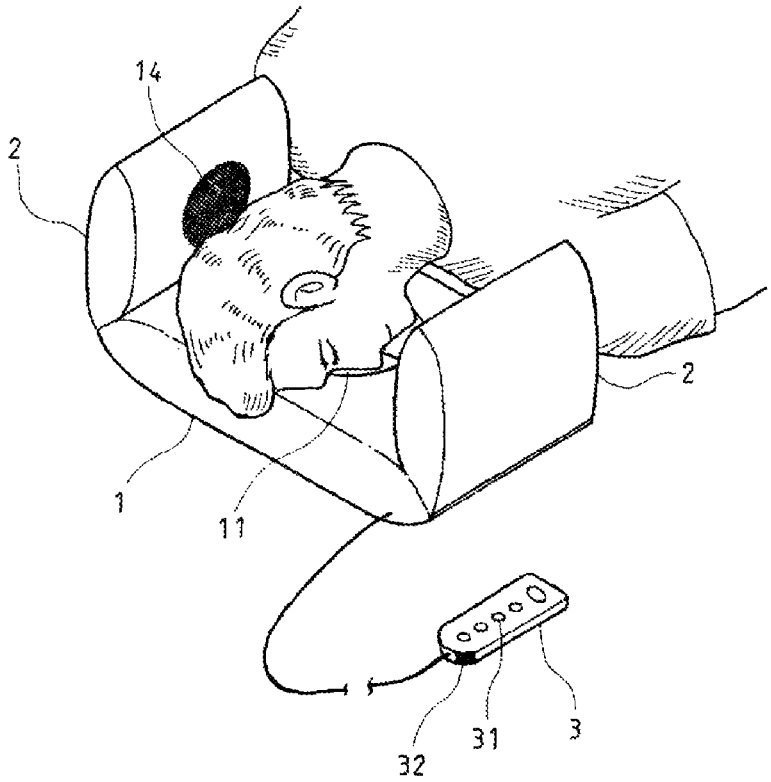
FIG. 3 is an application of the present invention.

Please refer to FIG. 3 and FIG. 1. When the matching element 111 is detached from the main body 1, one may place one's head in the through hole 11 when sleeping on one's stomach; this helps one sleep deeper without obstructing one's breath. Besides, the side bodies 2 may be regulated to rotate to a vertical position through the rotation of the rotative arm 152, which is driven by the motor 151; in this manner, without bothering one's bedfellow a user can listen to music coming from the speakers 14 which are placed right next to the user's ears. The pythoncidere released from the release opening 32 of the control unit 3 may also help the user sleep deeper.

Figure 4:
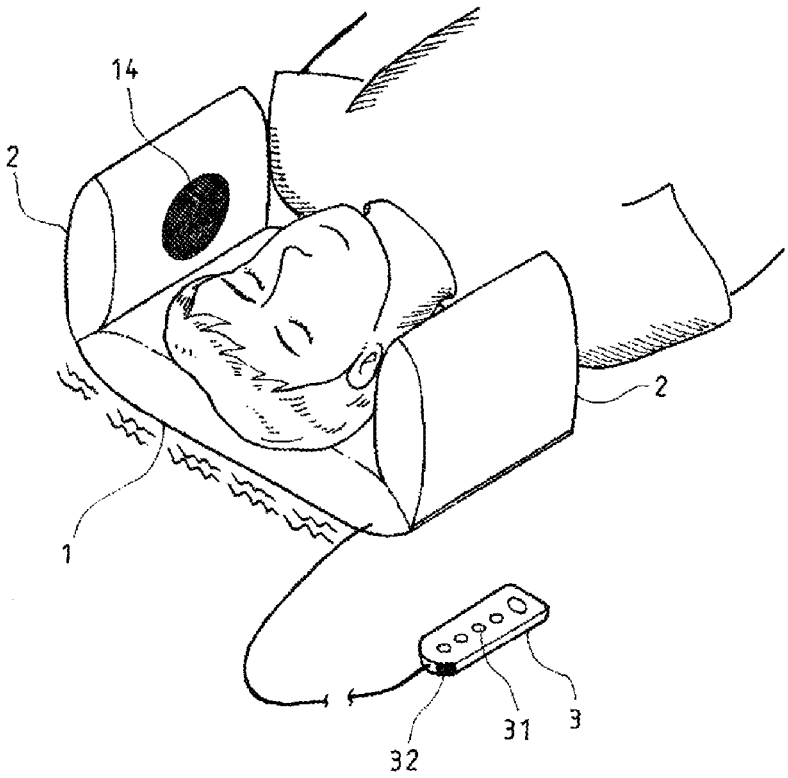
FIG. 4 is another application of the present invention.

Please refer to FIG. 4 and FIG. 1. The matching element 111 may be disposed in the through hole 11 of the main body 1 with exact matching, so that the upper surface of the main body 1 and the matching element 111 are level and fitted smoothly. In this manner, one may sleep on one's back (i.e. face up sleep) and lay one's head on the main body 1. The vibration unit 13 may be turned on by the button 31 of the control unit 3, so that the motor 131 may drive and rotate the eccentric cam 132 to provide massage to one's head, neck, or other body parts. In a preferable embodiment, the user can also set a vibration frequency or a vibration time on the control unit 3.

Figure 5:
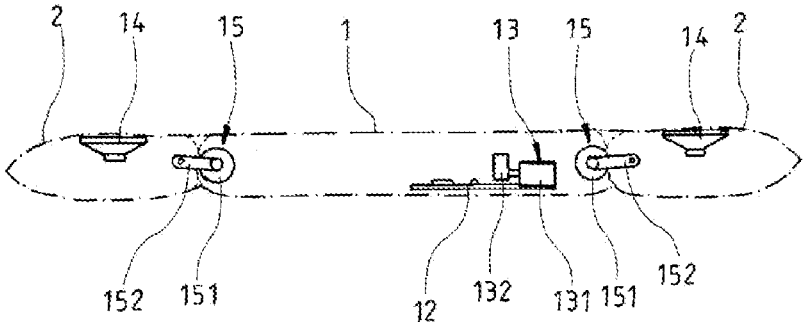
FIG. 5 is a schematic drawing of the present invention with the side bodies of the pillow device laid down.

Please refer to FIG. 5 and FIG. 1, when not playing music, the two side bodies 2 may be laid down to a horizontal position through the rotation of the rotation units 15 at the control of the control unit 3. In this manner, the multi-functional pillow device may be used as an ordinary pillow and may be easily stored.

Summarily, the multi-functional pillow device of the present invention has a through hole 11 disposed in the main body 1, has at least one speaker 14 disposed in the rotative side bodies 2, and allows input of audio music for the speakers 14 to play. This may achieve multiple purposes including providing massage, accommodating face down/up sleep, and music playing.

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A multi-functional pillow device, comprising:

a main body, having a through hole for face down sleep, a matching element for fitting with the through hole, and a circuit board inside the main body for connecting to a vibration unit and a rotation unit;

two side bodies, with each of the side body connected to the rotation unit and having a speaker connected to the circuit board, wherein the side bodies can be adjusted to a vertical position or a horizontal position by the rotation unit; and a control unit disposed at the external of the main body and connected to the circuit board for setting and controlling the vibration unit and the rotation unit, and for inputting audio data from USB, MP3 storage, or computer and for saving the audio data in the circuit board for playing from the speakers, wherein the matching element can be disposed in the through hole of the main body with exact matching and the vibration unit can be regulated to vibrate by the control unit.

2. The multi-functional pillow device of claim 1, wherein the through hole is circle shaped.

3. The multi-functional pillow device of claim 1, wherein the vibration unit is a motor which rotates an eccentric cam to generate vibration.

4. The multi-functional pillow device of claim 1, wherein the rotation unit has a motor disposed inside the main body and a rotative arm connected to the pivot of the motor and fixed to the side bodies, wherein the side bodies are adjusted to a vertical position or a horizontal position when the motor drives the rotative arm to rotate.

5. The multi-functional pillow device of claim 1, wherein the control unit has pythoncidere disposed inside and a release opening to release the pythoncidere.

* * * * *